US011069373B2

(12) United States Patent
Nakayama et al.

(10) Patent No.: US 11,069,373 B2
(45) Date of Patent: Jul. 20, 2021

(54) SPEECH PROCESSING METHOD, SPEECH PROCESSING APPARATUS, AND NON-TRANSITORY COMPUTER-READABLE STORAGE MEDIUM FOR STORING SPEECH PROCESSING COMPUTER PROGRAM

(71) Applicant: FUJITSU LIMITED, Kawasaki (JP)

(72) Inventors: Sayuri Nakayama, Kawasaki (JP); Taro Togawa, Kawasaki (JP); Takeshi Otani, Kawasaki (JP)

(73) Assignee: FUJITSU LIMITED, Kawasaki (JP)

( * ) Notice: Subject to any disclaimer, the term of this patent is extended or adjusted under 35 U.S.C. 154(b) by 182 days.

(21) Appl. No.: 16/136,487

(22) Filed: Sep. 20, 2018

(65) Prior Publication Data

US 2019/0096431 A1 Mar. 28, 2019

(30) Foreign Application Priority Data

Sep. 25, 2017 (JP) ..... JP2017-183588

(51) Int. Cl.

*G10L 25/90* (2013.01)
*G10L 25/18* (2013.01)
*G10L 25/21* (2013.01)
*G10L 25/84* (2013.01)

(52) U.S. Cl.

CPC ..... *G10L 25/90* (2013.01); *G10L 25/18* (2013.01); *G10L 25/21* (2013.01); *G10L 25/84* (2013.01)

(58) Field of Classification Search

CPC ..... G10L 25/90; G10L 15/20; G10L 25/14; G10L 21/00

See application file for complete search history.

(56) References Cited

U.S. PATENT DOCUMENTS 7,272,556 B1 * 9/2007 Aguilar ..... G10L 19/093 704/201
2003/0125934 A1 * 7/2003 Chen ..... G10L 25/90 704/207
2005/0131680 A1 * 6/2005 Chazan ..... G10L 13/08 704/205
2008/0281589 A1 11/2008 Wang et al.
2009/0067647 A1 * 3/2009 Yoshizawa ..... G10L 21/0272 381/119

(Continued)

FOREIGN PATENT DOCUMENTS

WO 2005/124739 12/2005
WO 2006/132159 12/2006

(Continued)

*Primary Examiner* — Jakieda R Jackson
(74) *Attorney, Agent, or Firm* — Fujitsu Patent Center

(57) ABSTRACT

A speech processing method for estimating a pitch frequency includes: executing a conversion process that includes acquiring an input spectrum from an input signal by converting the input signal from a time domain to a frequency domain; executing a feature amount acquisition process that includes acquiring a feature amount of speech likeness for each band included in a target band based on the input spectrum; executing a selection process that includes selecting a selection band selected from the target band based on the feature amount of speech likeness for each band; and executing a detection process that includes detecting a pitch frequency based on the input spectrum and the selection band.

20 Claims, 19 Drawing Sheets

(56) References Cited

U.S. PATENT DOCUMENTS

| | | | | |
|---|---|---|---|---|
| 2009/0210220 | A1 | 8/2009 | Mitsuyoshi et al. | |
| 2009/0323780 | A1* | 12/2009 | Lennen | G01S 19/21 375/148 |
| 2010/0158269 | A1* | 6/2010 | Zhang | G10L 21/0208 381/94.2 |
| 2011/0077886 | A1* | 3/2011 | Suk | H04B 17/345 702/76 |
| 2011/0301946 | A1 | 12/2011 | Satoh et al. | |
| 2012/0221344 | A1* | 8/2012 | Yamanashi | G10L 19/24 704/500 |
| 2013/0282373 | A1* | 10/2013 | Visser | G10L 21/0316 704/233 |
| 2014/0180674 | A1* | 6/2014 | Neuhauser | G10H 1/0008 704/9 |
| 2014/0350927 | A1* | 11/2014 | Yamabe | G10L 25/48 704/233 |
| 2016/0104490 | A1* | 4/2016 | Sukowski | G10L 19/06 704/501 |
| 2016/0112022 | A1* | 4/2016 | Butts | H03G 5/165 381/100 |
| 2017/0011746 | A1* | 1/2017 | Zhou | G10L 19/032 |

FOREIGN PATENT DOCUMENTS

| | | |
|---|---|---|
| WO | 2007/015489 | 2/2007 |
| WO | 2010/098130 | 9/2010 |

* cited by examiner

| | SELECTION BAND | CORRELATION VALUE | ESTIMATED VALUE |
|---|---|---|---|
| RELATED ART |  | f [Hz]: 0.30 | NONE<br>DETECTION FAILURE |
| PRESENT TECHNIQUE |  | f [Hz]: 0.60 | f [Hz]<br>POSITIVE |

SPEECH PROCESSING METHOD, SPEECH PROCESSING APPARATUS, AND NON-TRANSITORY COMPUTER-READABLE STORAGE MEDIUM FOR STORING SPEECH PROCESSING COMPUTER PROGRAM

CROSS-REFERENCE TO RELATED APPLICATION

This application is based upon and claims the benefit of priority of the prior Japanese Patent Application No. 2017-183588, filed on Sep. 25, 2017, the entire contents of which are incorporated herein by reference.

FIELD

The embodiments discussed herein are related to a speech processing method, a speech processing apparatus, and a non-transitory computer-readable storage medium for storing a speech processing computer program.

BACKGROUND

In recent years, in many companies, in order to estimate customer satisfaction and the like and proceed with marketing advantageously, there is a demand to acquire information on emotions and the like of a customer (or a respondent) from a conversation between the respondent and the customer. Human emotions often appear in speeches, for example, the height of the speech (pitch frequency) is one of the important factors in capturing human emotions.

Here, terms related to an input spectrum of a speech will be described. FIG. 16 is a diagram for describing terms related to the input spectrum. As illustrated in FIG. 16, generally, an input spectrum 4 of a human speech illustrates local maximum values at equal intervals. The horizontal axis of the input spectrum 4 is the axis corresponding to the frequency, and the vertical axis is the axis corresponding to the magnitude of the input spectrum 4.

The sound of the lowest frequency component is set as "fundamental sound". The frequency of the fundamental sound is set as a pitch frequency. In the example illustrated in FIG. 16, the pitch frequency is f. The sound of each frequency component (2*f*, 3*f*, and 4*f*) corresponding to an integral multiple of the pitch frequency is set as a harmonic sound. The input spectrum 4 includes a fundamental sound 4*a*, harmonic sounds 4*b*, 4*c*, and 4*d*.

Next, an example of Related Art 1 for estimating a pitch frequency will be described. FIG. 17 is a diagram (1) for describing a related art. As illustrated in FIG. 17, this related art includes a frequency conversion unit 10, a correlation calculation unit 11, and a search unit 12.

The frequency conversion unit 10 is a processing unit that calculates the frequency spectrum of the input speech by Fourier transformation of the input speech. The frequency conversion unit 10 outputs the frequency spectrum of the input speech to the correlation calculation unit 11. In the following description, the frequency spectrum of the input speech is referred to as an input spectrum.

The correlation calculation unit 11 is a processing unit that calculates a correlation value between cosine waves of various frequencies and an input spectrum for each frequency. The correlation calculation unit 11 outputs information correlating the frequency of the cosine wave and the correlation value to the search unit 12.

The search unit 12 is a processing unit that outputs the frequency of a cosine wave associated with the maximum correlation value among a plurality of correlation values as a pitch frequency.

FIG. 18 is a diagram (2) for describing a related art. In FIG. 18, the input spectrum 5*a* is the input spectrum output from the frequency conversion unit 10. The horizontal axis of the input spectrum 5*a* is the axis corresponding to the frequency, and the vertical axis is the axis corresponding to the magnitude of the spectrum.

Cosine waves 6*a* and 6*b* are part of the cosine wave received by the correlation calculation unit 11. The cosine wave 6*a* is a cosine wave having a frequency f[Hz] on the frequency axis and a peak at a multiple thereof. The cosine wave 6*b* is a cosine wave having a frequency 2*f*[Hz] on the frequency axis and a peak at a multiple thereof.

The correlation calculation unit 11 calculates a correlation value "0.95" between an input spectrum 5*a* and the cosine wave 6*a*. The correlation calculation unit 11 calculates a correlation value "0.40" between the input spectrum 5*a* and the cosine wave 6*b*.

The search unit 12 compares each correlation value and searches for a correlation value that is the maximum value. In the example illustrated in FIG. 18, since the correlation value "0.95" is the maximum value, the search unit 12 outputs the frequency f[Hz] corresponding to the correlation value "0.95" as a pitch frequency. In a case where the maximum value is less than a predetermined threshold value, the search unit 12 determines that there is no pitch frequency.

Examples of the related art include International Publication Pamphlet No. WO 2010/098130 and International Publication Pamphlet No. WO 2005/124739.

SUMMARY

According to an aspect of the invention, a speech processing method for estimating a pitch frequency, the method comprising: executing a conversion process that includes acquiring an input spectrum from an input signal by converting the input signal from a time domain to a frequency domain; executing a feature amount acquisition process that includes acquiring a feature amount of speech likeness for each band included in a target band based on the input spectrum; executing a selection process that includes selecting a selection band selected from the target band based on the feature amount of speech likeness for each band; and executing a detection process that includes detecting a pitch frequency based on the input spectrum and the selection band.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

DESCRIPTION OF EMBODIMENTS

There is a problem that the estimation precision of the pitch frequency may not be improved with the above-described related art.

Figure 19:
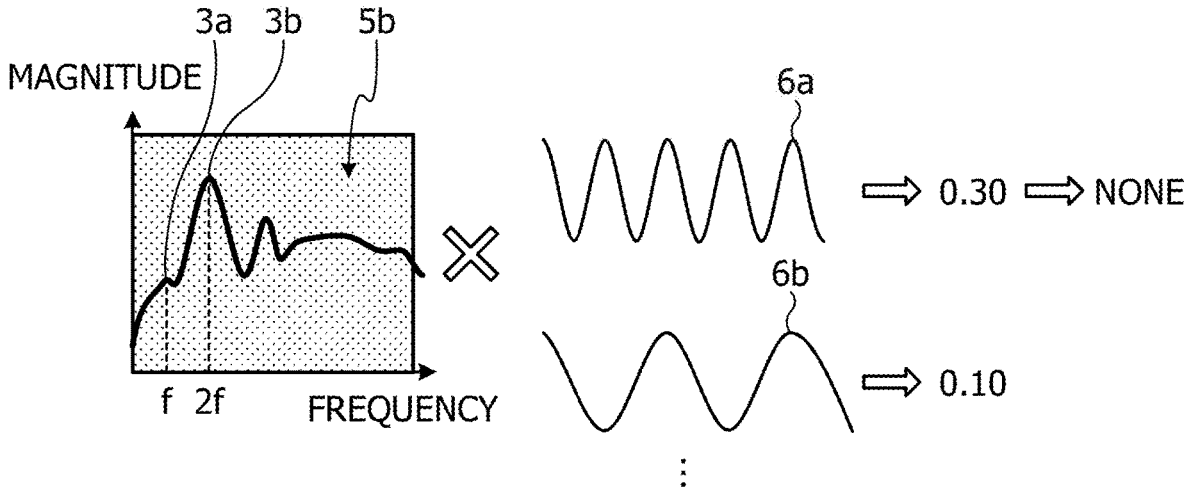
FIG. 19 (RELATED ART)
FIG. 19 is a diagram for describing a problem of the related art.

FIG. 19 is a diagram for describing a problem of the related art. For example, depending on the recording environment, in a case where the fundamental sound or a part of the harmonic sound is not clear, a correlation value with a cosine wave becomes small and it is difficult to detect a pitch frequency. In FIG. 19, the horizontal axis of an input spectrum 5*b* is the axis corresponding to the frequency, and the vertical axis is the axis corresponding to the magnitude of the spectrum. In the input spectrum 5*b*, a fundamental sound 3*a* is small and a harmonic sound 3*b* is large due to the influence of noise or the like.

For example, the correlation calculation unit 11 calculates a correlation value "0.30" between the input spectrum 5*b* and the cosine wave 6*a*. The correlation calculation unit 11 calculates a correlation value "0.10" between the input spectrum 5*b* and the cosine wave 6*b*.

The search unit 12 compares each correlation value and searches for a correlation value that is the maximum value. In addition, the threshold value is set to "0.4". Then, since the maximum value "0.30" is less than the threshold value, the search unit 12 determines that there is no pitch frequency.

According to one aspect of the present disclosure, a technique for improving the accuracy of pitch frequency estimation in speech processing is provided.

Examples of a speech processing program, a speech processing method and a speech processing apparatus disclosed in the present application will be described in detail below with reference to drawings. The present disclosure is not limited by this example.

Example 1

Figure 1:
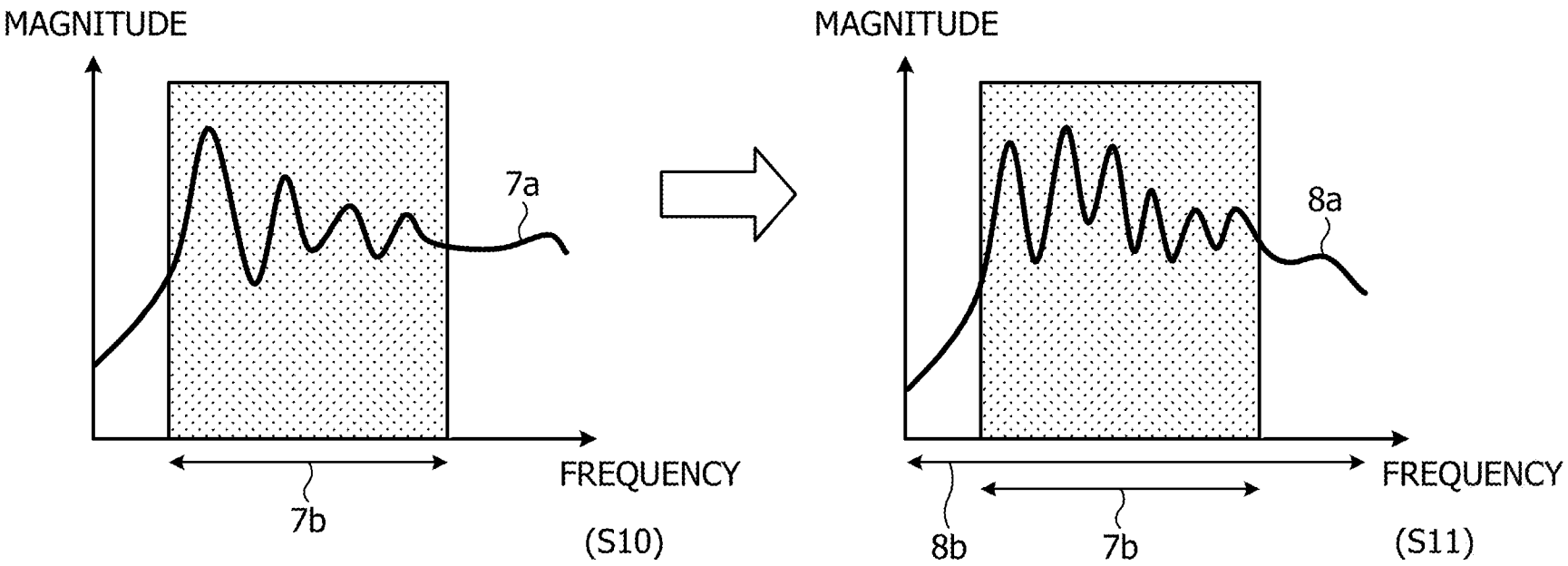
FIG. 1 is a diagram (2) for describing the processing of a speech processing apparatus according to Example 1.

FIG. 1 is a diagram for describing the processing of the speech processing apparatus according to Example 1. The speech processing apparatus divides an input signal into a plurality of frames and calculates an input spectrum of the frame. An input spectrum 7*a* is an input spectrum calculated from a certain frame (past frame). In FIG. 1, the horizontal axis of the input spectrum 7*a* is the axis corresponding to the frequency, and the vertical axis is the axis corresponding to the magnitude of the input spectrum. Based on the input spectrum 7*a*, the speech processing apparatus calculates a feature amount of speech likeness and learns a band 7*b* which is likely to be a speech based on the feature amount of speech likeness. The speech processing apparatus learns and updates the speech-like band 7*b* by repeatedly executing the above-described processing for other frames (step S10).

When receiving a frame to be detected for a pitch frequency, the speech processing apparatus calculates an input spectrum 8*a* of the frame. In FIG. 1, the horizontal axis of the input spectrum 8*a* is the axis corresponding to the frequency, and the vertical axis is the axis corresponding to the magnitude of the input spectrum. The speech processing apparatus calculates the pitch frequency based on the input spectrum 8*a* corresponding to the speech-like band 7*b* learned in step S10 in a target band 8*b* (step S11).

Figure 2:
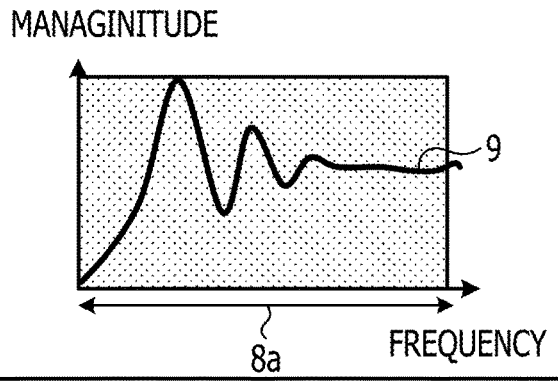
FIG. 2 is a diagram for describing an example of the effect of the speech processing apparatus according to Example 1.
Figure 2:
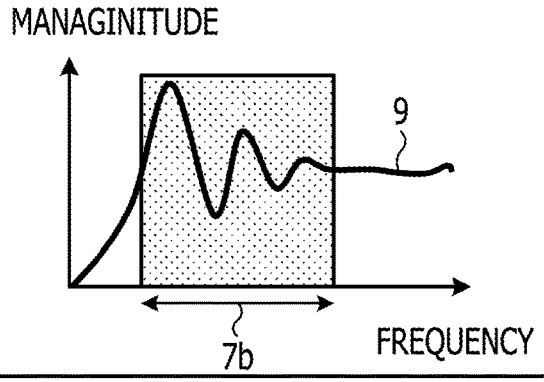

FIG. 2 is a diagram for describing an example of the effect of the speech processing apparatus according to Example 1. The horizontal axis of each input spectrum 9 in FIG. 2 is the axis corresponding to the frequency, and the vertical axis is the axis corresponding to the magnitude of the input spectrum.

In the related art, the correlation value between the input spectrum 9 of the target band 8*b* and a cosine wave is calculated. Then, the correlation value (maximum value) decreases due to the influence of the recording environment, and detection failure occurs. In the example illustrated in FIG. 2, the correlation value is 0.30 [Hz], which is not equal to or higher than a threshold value, and an estimated value is "none". Here, as an example, the threshold value is set to "0.4".

On the other hand, as described with reference to FIG. 1, the speech processing apparatus according to Example 1 learns the speech-like band 7*b* that is not easily influenced by the recording environment. The speech processing apparatus calculates a correlation value between the input spectrum 9 of the band 7*b* which is likely to be a speech like and the cosine wave. Then, an appropriate correlation value (maximum value) may be obtained without being influenced by the recording environment, it is possible to suppress detection failure and to improve the accuracy of pitch frequency estimation. In the example illustrated in FIG. 2, the correlation value is 0.60 [Hz], which is equal to or higher than the threshold value, and an appropriate estimation f [Hz] is detected.

Figure 3:
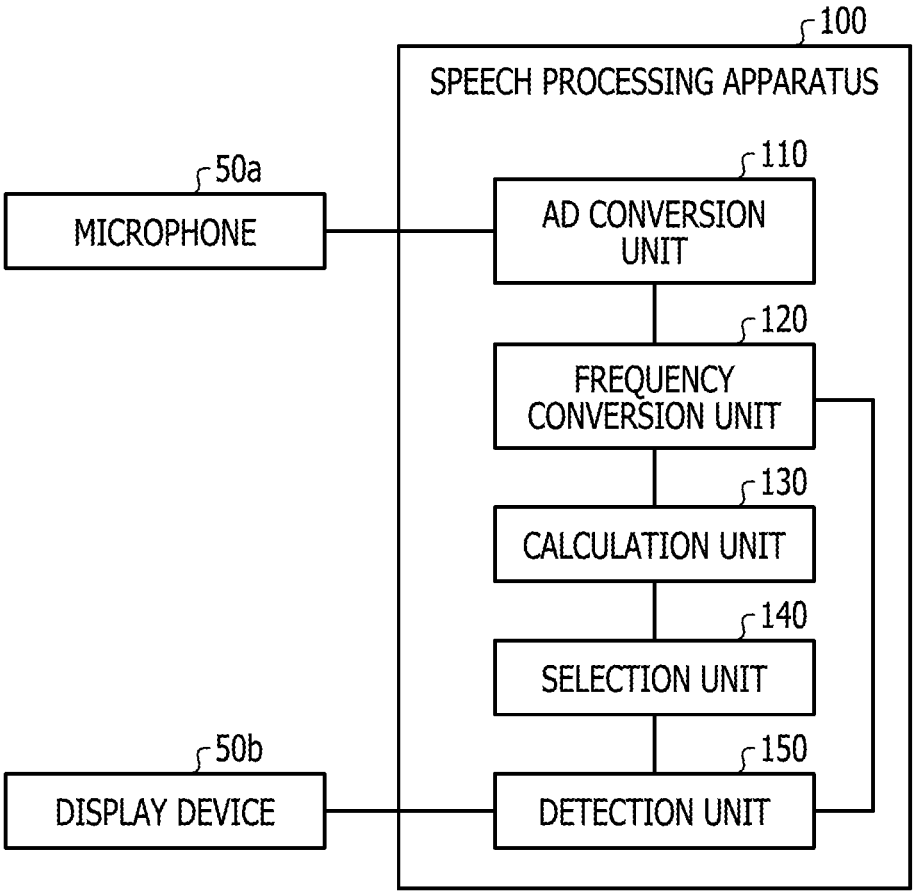
FIG. 3 is a functional block diagram illustrating a configuration of a speech processing apparatus according to Example 1.

Next, an example of a configuration of the speech processing apparatus according to Example 1 will be described. FIG. 3 is a functional block diagram illustrating the configuration of the speech processing apparatus according to Example 1. As illustrated in FIG. 3, this speech processing apparatus 100 is connected to a microphone 50*a* and a display device 50*b*.

The microphone 50*a* outputs a signal of speech (or other than speech) collected from a speaker to the speech processing apparatus 100. In the following description, the signal collected by the microphone 50*a* is referred to as "input signal". For example, the input signal collected while the speaker is uttering includes a speech. In addition, the speech may include background noise and the like in some cases.

Figure 4:
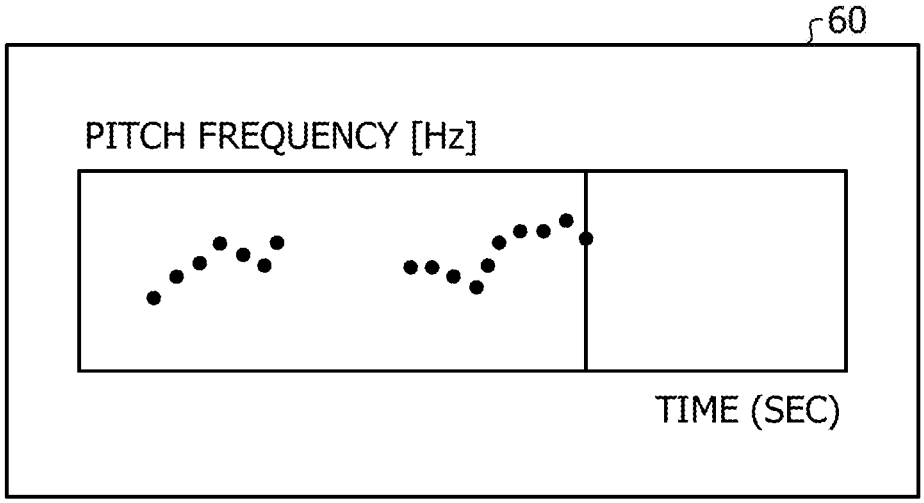
FIG. 4 is a diagram illustrating an example of a display screen.

The display device 50*b* is a display device that displays information on the pitch frequency detected by the speech processing apparatus 100. The display device 50*b* corresponds to a liquid crystal display, a touch panel, or the like. FIG. 4 is a diagram illustrating an example of a display screen. For example, the display device 50*b* displays a display screen 60 illustrating the relationship between time and pitch frequency. In FIG. 4, the horizontal axis is the axis corresponding to time, and the vertical axis is the axis corresponding to the pitch frequency.

The following returns to the description of FIG. 3. The speech processing apparatus 100 includes an AD conversion unit 110, a frequency conversion unit 120, a calculation unit 130, a selection unit 140, and a detection unit 150.

The AD conversion unit 110 is a processing unit that receives an input signal from the microphone 50*a* and executes analog-to-digital (AD) conversion. Specifically, the AD conversion unit 110 converts an input signal (analog signal) into an input signal (digital signal). The AD conversion unit 110 outputs the input signal (digital signal) to the frequency conversion unit 120. In the following description, an input signal (digital signal) output from the AD conversion unit 110 is simply referred to as input signal.

The frequency conversion unit 120 divides an input signal x(n) into a plurality of frames of a predetermined length and performs fast Fourier transform (FFT) on each frame to calculate a spectrum X(f) of each frame. Here, "x(n)" indicates an input signal of sample number n. "X(f)" indicates a spectrum of the frequency (frequency number) f. In other words, the frequency conversion unit 120 is configured to convert the input signal x(n) from a time domain to a frequency domain.

The frequency conversion unit 120 calculates a power spectrum P(l, k) of the frame based on Equation (1). In Equation (1), a variable "l" indicates a frame number, and a variable "f" indicates a frequency number. In the following description, the power spectrum is expressed as an "input spectrum". The frequency conversion unit 120 outputs the information of the input spectrum to the calculation unit 130 and the detection unit 150.

$$P(f)=10\log_{10}|X(f)|^2 \tag{1}$$

The calculation unit 130 is a processing unit that calculates a feature amount of speech likeness of each band included in a target area based on the information of the input spectrum. The calculation unit 130 calculates a smoothed power spectrum P'(m, f) based on Equation (2). In Equation (2), a variable "m" indicates a frame number, and a variable "f" indicates a frequency number. The calculation unit 130 outputs the information of the smoothed power spectrum corresponding to each frame number and each frequency number to the selection unit 140.

$$P'(f)=0.99\cdot P'(m-1,f)+0.01\cdot P(f) \tag{2}$$

The selection unit 140 is a processing unit that selects a speech-like band out of the entire band (target band) based on the information of the smoothed power spectrum. In the following description, the band that is likely to be a speech selected by the selection unit 140 is referred to as "selection band". Hereinafter, the processing of the selection unit 140 will be described.

The selection unit 140 calculates an average value PA of the entire band of the smoothed power spectrum based on Equation (3). In Equation (3), N represents the total number of bands. The value of N is preset.

$$PA=\frac{1}{N}\sum_{i=0}^{N-1}P'(m,i) \tag{3}$$

Figure 5:
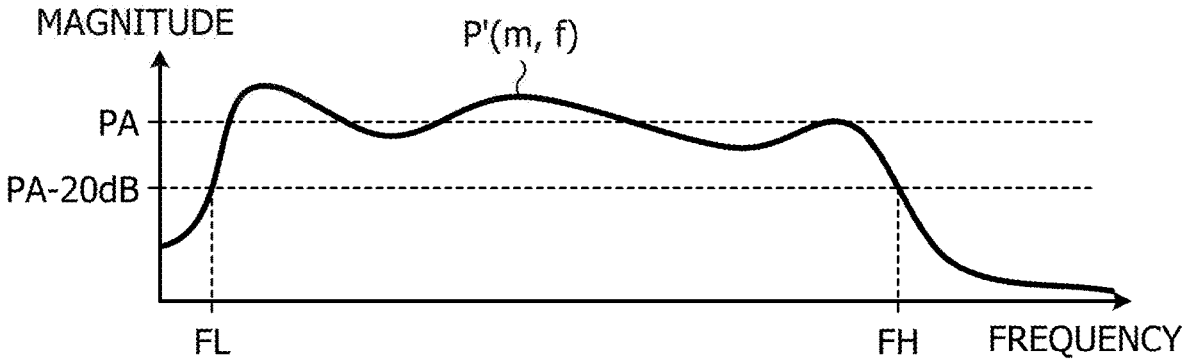
FIG. 5 is a diagram for describing the processing of a selection unit according to Example 1.

The selection unit 140 selects a selection band by comparing the average value PA of the entire band with the smoothed power spectrum. FIG. 5 is a diagram for describing the processing of a selection unit according to Example 1. In FIG. 5, the smoothed power spectrum P'(m, f) calculated from the frame with a frame number "m" is illustrated. In FIG. 5, the horizontal axis is the axis corresponding to the frequency, and the vertical axis is the axis corresponding to the magnitude of the smoothed power spectrum P'(m, f).

The selection unit 140 compares the value of the "average value PA-20 dB" with the smoothed power spectrum P'(m, f) and specifies a lower limit FL and an upper limit FH of the bands that are "smoothed power spectrum P'(m, f)>average value PA-20 dB". Similarly, the selection unit 140 repeats the processing of specifying the lower limit FL and the upper limit FH for the smoothed power spectrum P'(m, f) corresponding to another frame number and specifies an average value of the lower limit FL and the average value of the upper limit FH.

For example, the selection unit 140 calculates an average value FL'(m) of FL based on Equation (4). The selection unit 140 calculates an average value FH'(m) of FH based on Equation (5). α included in Expressions (4) and (5) is a preset value.

$$FL'(m)=(1-\alpha)\times FL'(m-1)+\alpha\times FL(m) \tag{4}$$

$$FH'(m)=(1-\alpha)\times FH'(m-1)+\alpha\times FH(m) \tag{5}$$

The selection unit 140 selects a band from the average value FL'(m) of FL to the upper limit FH'(m) as a selection band. The selection unit 140 outputs information on the selection band to the detection unit 150.

The detection unit 150 is a processing unit that detects a pitch frequency based on the input spectrum and information on the selection band. An example of the processing of the detection unit 150 will be described below.

The detection unit 150 normalizes the input spectrum based on Equations (6) and (7). In Expression (6), $P_{max}$ indicates the maximum value of P(f). $P_n(f)$ indicates a normalized spectrum.

$$P_{max}=\max(P(f)) \tag{6}$$

$$P_n(f)=P(f)/P_{max} \tag{7}$$

The detection unit 150 calculates a degree of coincidence J(g) between the normalized spectrum in the selection band and a cosine (COS) waveform based on the Equation (8). In Equation (8), the variable "g" indicates the cycle of the COS waveform. FL corresponds to the average value FL'(m) selected by the selection unit 140. FH corresponds to the average value FH'(m) selected by the selection unit 140.

$$J(g) = \sum_{i=FL}^{FH} (P_n(i) \cdot \cos(2\pi i/g)) \quad (8)$$

The detection unit 150 detects the cycle g, at which the degree of coincidence (correlation) is the largest, as a pitch frequency F0 based on Expression (9).

$$F0 = \text{argmax}(J(g)) \quad (9)$$

The detection unit 150 detects the pitch frequency of each frame by repeatedly executing the above processing. The detection unit 150 may generate information on a display screen in which time and a pitch frequency are associated with each other and cause the display device 50*b* to display the information. For example, the detection unit 150 estimates the time from the frame number "m".

Figure 6:
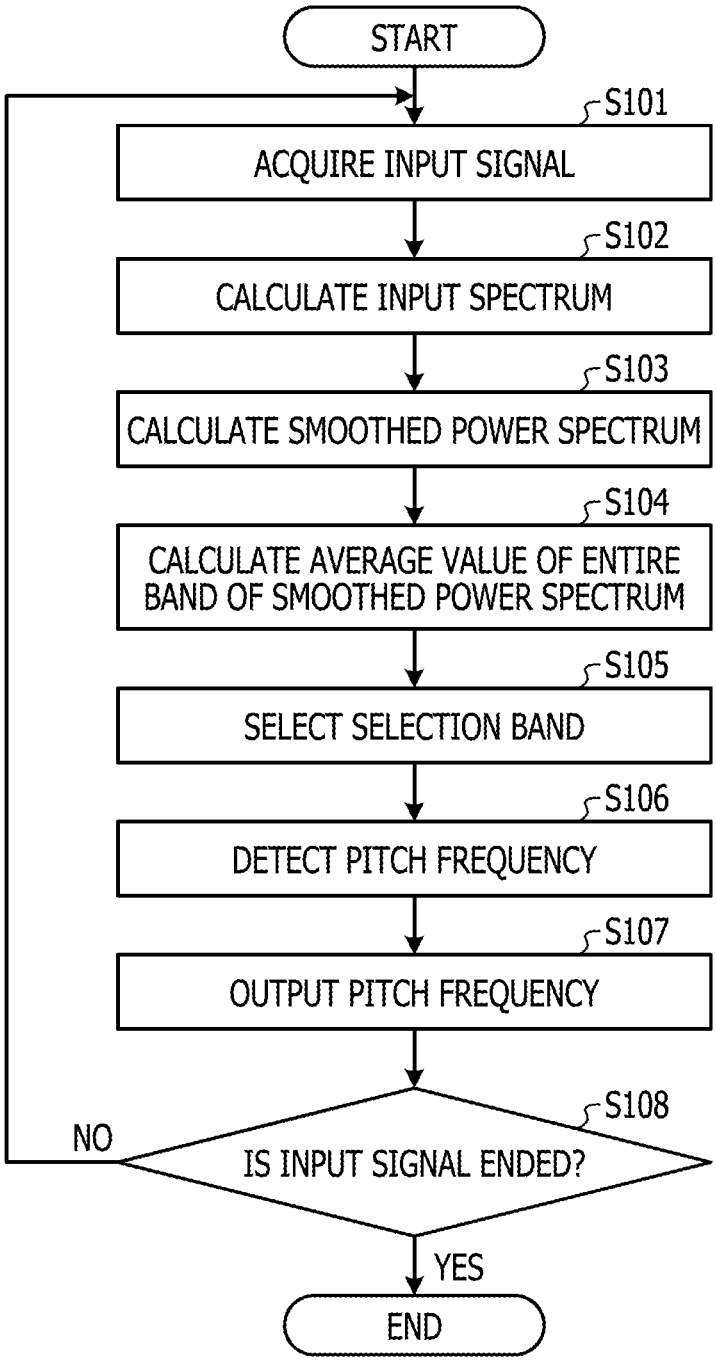
FIG. 6 is a flowchart illustrating a processing procedure of the speech processing apparatus according to Example 1.

Next, a processing procedure of the speech processing apparatus 100 according to Example 1 will be described. FIG. 6 is a flowchart illustrating a processing procedure of the speech processing apparatus according to Example 1. As illustrated in FIG. 6, the speech processing apparatus 100 acquires an input signal from the microphone 50*a* (step S101).

The frequency conversion unit 120 of the speech processing apparatus 100 calculates an input spectrum (step S102). The calculation unit 130 of the speech processing apparatus 100 calculates a smoothed power spectrum based on the input spectrum (step S103).

The selection unit 140 of the speech processing apparatus 100 calculates the average value PA of the entire band of the smoothed power spectrum (step S104). The selection unit 140 selects a selection band based on the average value PA and the smoothed power spectrum of each band (step S105).

The detection unit 150 of the speech processing apparatus 100 detects a pitch frequency based on the input spectrum corresponding to the selection band (step S106). The detection unit 150 outputs the pitch frequency to the display device 50*b* (step S107).

In a case where the input signal is not ended (step S108, No), the speech processing apparatus 100 moves to step S101. On the other hand, in a case where the input signal is ended (step S108, Yes), the speech processing apparatus 100 ends the processing.

Next, the effect of the speech processing apparatus 100 according to Example 1 will be described. Based on the feature amount of speech likeness, the speech processing apparatus 100 selects a selection band which is not easily influenced by the recording environment from the target band (entire band) and detects a pitch frequency by using the input spectrum of the selected selection band. As a result, it is possible to improve the accuracy of the pitch frequency estimation.

The speech processing apparatus 100 calculates a smoothed power spectrum obtained by smoothing the input spectrum of each frame and selects a selection band by comparing the average value PA of the entire band of the smoothed power spectrum with the smoothed power spectrum. As a result, it is possible to accurately select a band that is likely to be a speech as a selection band. In this example, as an example, the processing is performed by using the input spectrum, but instead of the input spectrum, a selection band may be selected by using the SNR.

Example 2

Figure 7:
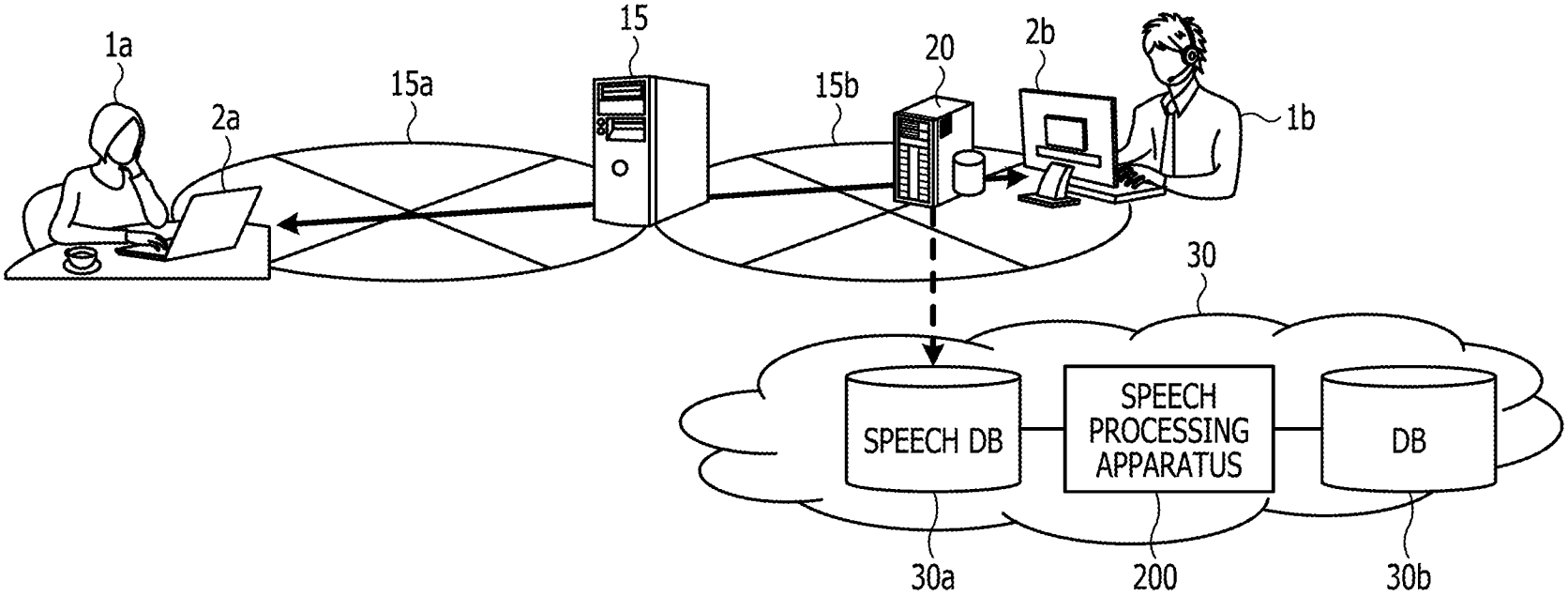
FIG. 7 is a diagram illustrating an example of a speech processing system according to Example 2.

FIG. 7 is a diagram illustrating an example of a speech processing system according to Example 2. As illustrated in FIG. 7, the speech processing system includes terminal devices 2*a* and 2*b*, a gateway (GW) 15, a recording device 20, and a cloud network 30. The terminal device 2*a* is connected to the GW 15 via the telephone network 15*a*. The recording device 20 is connected to the GW 15, the terminal device 2*b*, and the cloud network 30 via an individual network 15*b*.

The cloud network 30 includes a speech database (DB) 30*a*, a DB 30*b*, and a speech processing apparatus 200. The speech processing apparatus 200 is connected to the speech DB 30*a* and the DB 30*b*. The processing of the speech processing apparatus 200 may be executed by a plurality of servers (not illustrated) on the cloud network 30.

The terminal device 2*a* transmits a signal of the speech (or other than speech) of a speaker 1*a* collected by a microphone (not illustrated) to the recording device 20 via the GW 15. In the following description, a signal transmitted from the terminal device 2*a* is referred to as a first signal.

The terminal device 2*b* transmits a signal of the speech (or other than speech) of the speaker 1*b* collected by a microphone (not illustrated) to the recording device 20. In the following description, a signal transmitted from the terminal device 2*b* is referred to as a second signal.

The recording device 20 records the first signal received from the terminal device 2*a* and registers the information of the recorded first signal in the speech DB 30*a*. The recording device 20 records the second signal received from the terminal device 2*b* and registers information of the recorded second signal in the speech DB 30*a*.

The speech DB 30*a* includes a first buffer (not illustrated) and a second buffer (not illustrated). For example, the speech DB 30*a* corresponds to a semiconductor memory element such as a RAM, a ROM, a flash memory, or a storage device such as an HDD.

The first buffer is a buffer that holds the information of the first signal. The second buffer is a buffer that holds the information of the second signal.

The DB 30*b* stores an estimation result of the pitch frequency by the speech processing apparatus 200. For example, the DB 30*b* corresponds to a semiconductor memory element such as a RAM, a ROM, a flash memory, or a storage device such as an HDD.

The speech processing apparatus 200 acquires the first signal from the speech DB 30*a*, estimates a pitch frequency of the utterance of the speaker 1*a*, and registers the estimation result in the DB 30*b*. The speech processing apparatus 200 acquires the second signal from the speech DB 30*a*, estimates a pitch frequency of the utterance of the speaker 1*b*, and registers the estimation result in the DB 30*b*. In the following description of the speech processing apparatus 200, the processing in which the speech processing apparatus 200 acquires the first signal from the speech DB 30*a* and estimates a pitch frequency of the utterance of the speaker 1*a* will be described. The processing of acquiring the second signal from the speech DB 30*a* and estimating the pitch frequency of the utterance of the speaker 1*b* by the speech processing apparatus 200 corresponds to the processing of acquiring the first signal from the speech DB 30*a* and estimating the pitch frequency of the utterance of the speaker 1*a*, and thus the description thereof will be omitted. In the following description, the first signal is referred to as "input signal".

Figure 8:
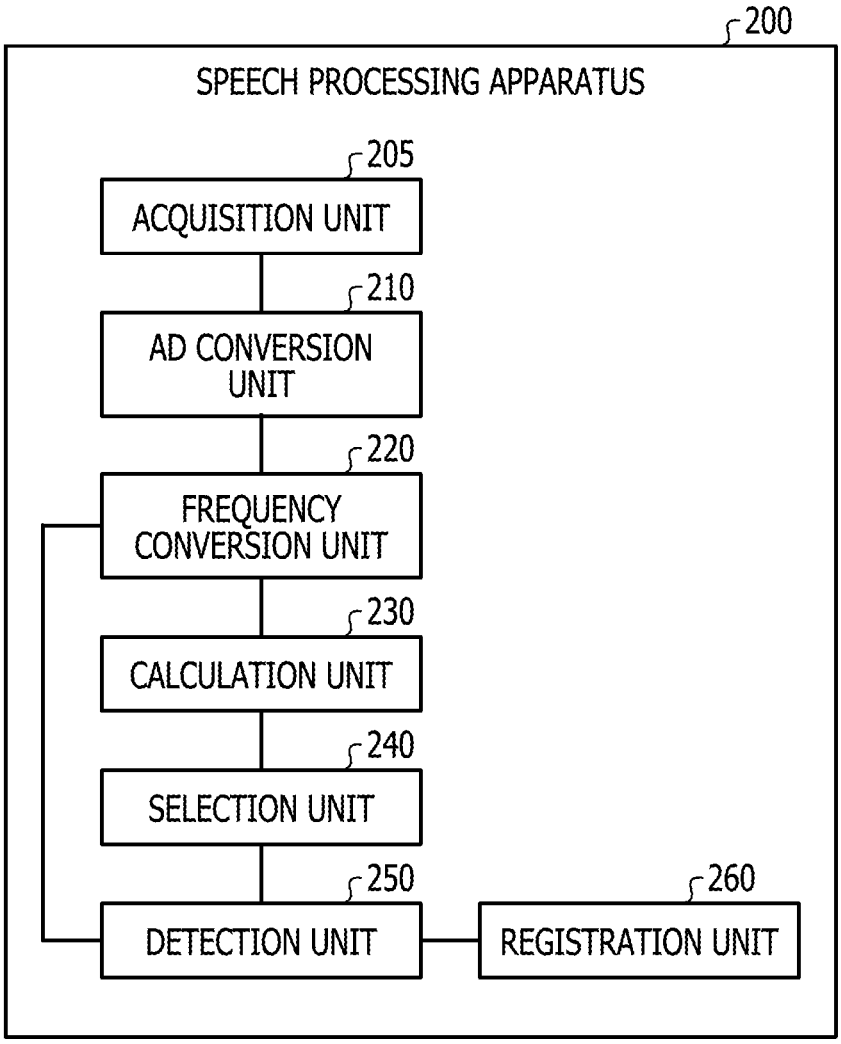
FIG. 8 is a functional block diagram illustrating a configuration of a speech processing apparatus according to Example 2.

FIG. 8 is a functional block diagram illustrating the configuration of the speech processing apparatus according to Example 2. As illustrated in FIG. 8, the speech processing apparatus 200 includes an acquisition unit 205, an AD conversion unit 210, a frequency conversion unit 220, a calculation unit 230, a selection unit 240, a detection unit 250, and a registration unit 260.

The acquisition unit 205 is a processing unit that acquires an input signal from the speech DB 30*a*. The acquisition unit 205 outputs the acquired input signal to the AD conversion unit 210.

The AD conversion unit 210 is a processing unit that acquires an input signal from the acquisition unit 205 and executes AD conversion on the acquired input signal. Specifically, the AD conversion unit 210 converts an input signal (analog signal) into an input signal (digital signal). The AD conversion unit 210 outputs the input signal (digital signal) to the frequency conversion unit 220. In the following description, an input signal (digital signal) output from the AD conversion unit 210 is simply referred to as input signal.

The frequency conversion unit 220 is a processing unit that calculates an input spectrum of a frame based on an input signal. The processing of calculating the input spectrum of the frame by the frequency conversion unit 220 corresponds to the processing of the frequency conversion unit 120, and thus the description thereof will be omitted. The frequency conversion unit 220 outputs the information of the input spectrum to the calculation unit 230 and the detection unit 250.

The calculation unit 230 is a processing unit that divides a target band (entire band) of the input spectrum into a plurality of sub-bands and calculates a change amount for each sub-band. The calculation unit 230 performs processing of calculating a change amount of the input spectrum in the time direction and processing of calculating the change amount of the input spectrum in the frequency direction.

The calculation unit 230 calculates the change amount of the input spectrum in the time direction will be described. The calculation unit 230 calculates the change amount in the time direction in a sub-band based on the input spectrum of a previous frame and the input spectrum of a current frame.

For example, the calculation unit 130 calculates a change amount $\Delta_T$ of the input spectrum in the time direction based on Equation (10). In Equation (10), "$N_{SUB}$" indicates the total number of sub-bands. "m" indicates the frame number of the current frame. "l" is the sub-band number.

$$\Delta_T(m, 1) = \frac{1}{N_{SUB}} \cdot \sum_{j=1}^{N_{SUB}} |P(m-1, (1-1) \cdot N_{SUB} + j) - P(m, (1, 1) \cdot N_{SUB} + j)| \tag{10}$$

Figure 9:
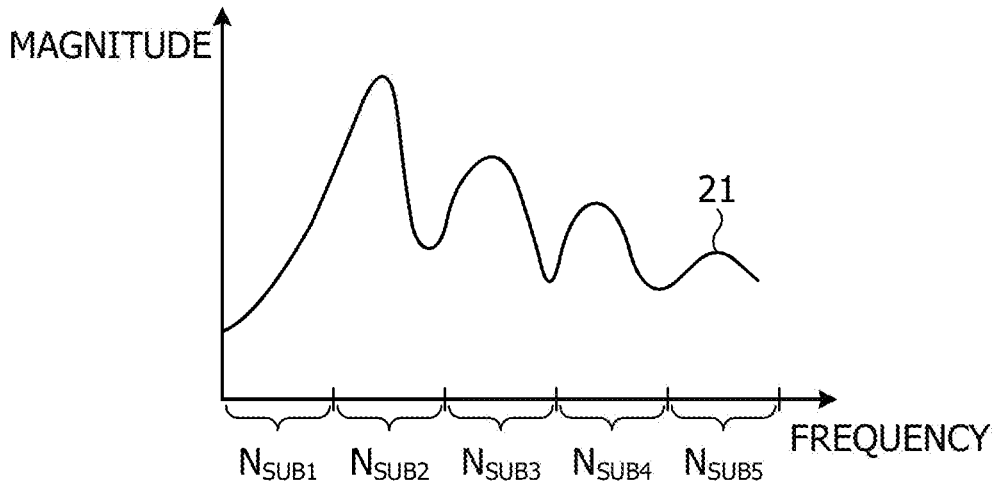
FIG. 9 is a diagram for supplementing the processing of a calculation unit according to Example 2.

FIG. 9 is a diagram for supplementing the processing of a calculation unit according to Example 2. For example, the input spectrum 21 illustrated in FIG. 9 illustrates the input spectrum detected from the frame with frame number m. The horizontal axis is the axis corresponding to the frequency, and the vertical axis is the axis corresponding to the magnitude of the input spectrum 21. In the example illustrated in FIG. 9, the target band is divided into a plurality of sub-bands $N_{SUB1}$ to $N_{SUB5}$. For example, sub-bands $N_{SUB1}$, $N_{SUB2}$, $N_{SUB3}$, $N_{SUB4}$, and $N_{SUB5}$ correspond to sub-bands with sub-band numbers l=1 to 5.

Subsequently, the calculation unit 230 calculates the change amount of the input spectrum in the frequency direction will be described. The calculation unit 230 calculates the change amount of the input spectrum in the sub-band based on the input spectrum of the current frame.

For example, the calculation unit 230 calculates a change amount $\Delta_F$ of the input spectrum in the frequency direction based on Equation (11). The calculation unit 230 repeatedly executes the above processing for each sub-band described with reference to FIG. 9.

$$\Delta_F(m, 1) = \frac{1}{N_{SUB}} \cdot \sum_{j=1}^{N_{SUB}} |P(m, (1-1) \cdot N_{SUB} + j - 1) - P(m, (1, 1) \cdot N_{SUB} + j)| \tag{11}$$

The calculation unit 230 outputs information on the change amount $\Delta_T$ of the input spectrum in the time direction and the change amount $\Delta_F$ of the input spectrum of the frequency for each sub-band to the selection unit 240.

The selection unit 240 is a processing unit that selects a selection band based on the information on the amount of change $\Delta_T$ of the input spectrum in the time direction and the amount of change $\Delta_F$ of the input spectrum of the frequency for each sub-band. The selection unit 240 outputs information on the selection band to the detection unit 250.

The selection unit 240 determines whether or not the sub-band with the sub-band number "l" is a selection band based on Equation (12). In Expression (12), SL(l) is a selection band flag, and the case of SL(l)=1 indicates that the sub-band with the sub-band number "l" is the selection band.

$$SL(1) = \begin{cases} 1 & \text{if } ((\Delta_F(m, 1) > TH_1) \cap (\Delta_T(m, 1) > TH_2)) \\ 0 & \text{else} \end{cases} \tag{12}$$

As illustrated in Equation (12), for example, in a case where the change amount $\Delta_T$ is greater than a threshold value TH1 and the change amount $\Delta_F$ is greater than a threshold value TH 2, the selection band 240 determines that the sub-band with the sub-band number "l" is a selection band, and SL(l)=1 is set. The selection unit 240 specifies a selection band by executing similar processing for each sub-band number. For example, in a case where the values of SL(2) and SL(3) are 1 and the values of other SL(1), SL(4), and SL(5) are 0, $N_{SUB2}$ and $N_{SUB3}$ illustrated in FIG. 9 are selection bands.

The detection unit 250 is a processing unit that detects a pitch frequency based on the input spectrum and information on the selection band. An example of the processing of the detection unit 250 will be described below.

Like the detection unit 150, the detection unit 250 normalizes the input spectrum based on Equations (6) and (7). The normalized input spectrum is referred to as a normalized spectrum.

The detection unit 250 calculates a degree of coincidence $J_{SUB}(g, l)$ between the normalized spectrum of the sub-band determined as a selection band and the COS (cosine) waveform based on Equation (13). "L" in equation (13) indicates the total number of sub-bands. The degree of coincidence $J_{SUB}(g, l)$ between the normalized spectrum of the sub-band not corresponding to the selection band and the COS (cosine) waveform is 0 as illustrated in Expression (13).

$$J_{SUB}(g, 1) = \begin{cases} \sum_{j=(1-1) \cdot L}^{(1-1) \cdot L-1} (P_n(j) \cdot \cos(2\pi j/g)) & \text{if } (SL(1) = 1) \\ 0 & \text{else} \end{cases} \tag{13}$$

The detection unit 250 detects the maximum degree of coincidence J(g) among the coincidence degrees $J_{SUB}(g, k)$ of each sub-band based on Equation (14).

$$J(g) = \sum_{k=1}^{L} (J_{SUB}(g, k)) \tag{14}$$

The detection unit 250 detects the cycle g of the normalized spectrum of the sub-band (selection band) having the highest degree of coincidence and the COS waveform as the pitch frequency F0, based on Expression (15).

$$F0 = \text{argmax}(J(g)) \tag{15}$$

The detection unit 250 detects the pitch frequency of each frame by repeatedly executing the above processing. The detection unit 250 outputs information on the detected pitch frequency of each frame to the registration unit 260.

The registration unit 260 is a processing unit that registers the information on the pitch frequency of each frame detected by the detection unit 250 in the DB 30*b*.

Figure 10:
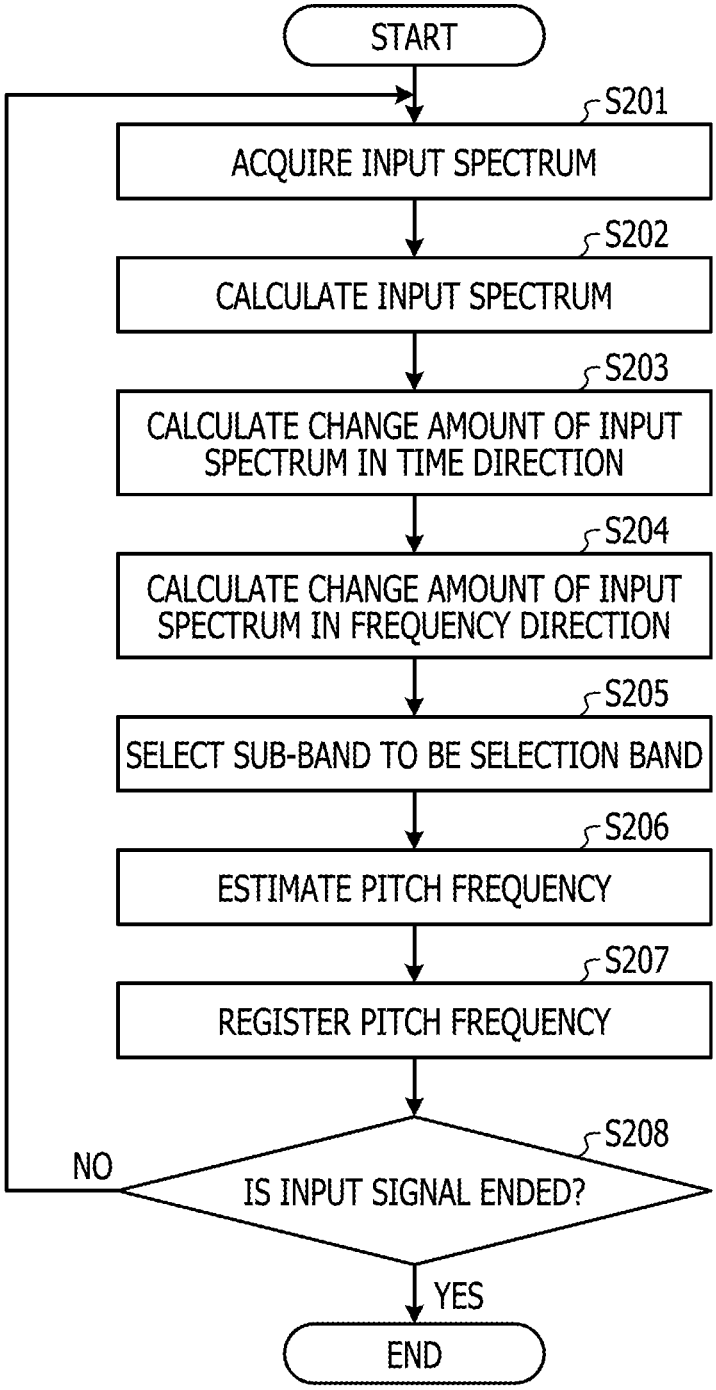
FIG. 10 is a flowchart illustrating a processing procedure of the speech processing apparatus according to Example 2.

Next, a processing procedure of the speech processing apparatus 200 according to Example 2 will be described. FIG. 10 is a flowchart illustrating a processing procedure of the speech processing apparatus according to Example 2. As illustrated in FIG. 10, the acquisition unit 205 of the speech processing apparatus 200 acquires an input signal (step S201).

The frequency conversion unit 220 of the speech processing apparatus 200 calculates an input spectrum (step S202). The calculation unit 230 of the speech processing apparatus 200 calculates the change amount $\Delta_T$ of the input spectrum in the time direction (step S203). The calculation unit 230 calculates the change amount $\Delta_F$ of the input spectrum in the frequency direction (step S204).

The selection unit 240 of the speech processing apparatus 200 selects a sub-band to be a selection band (step S205). The detection unit 250 of the speech processing apparatus 200 detects a pitch frequency based on the input spectrum corresponding to the selection band (step S206). The registration unit 260 outputs the pitch frequency to the DB 30*b* (step S207).

In a case where the input signal is ended (step S208, Yes), the speech processing apparatus 200 ends the processing. On the other hand, in a case where the input signal is not ended (step S208, No), the speech processing apparatus 200 moves to step S201.

Next, the effect of the speech processing apparatus 200 according to Example 2 will be described. The speech processing apparatus 200 selects a band to be a selection band from a plurality of sub-bands based on the change amount $\Delta_T$ of the input spectrum in the time direction and the change amount $\Delta_F$ of the frequency direction and detects a pitch frequency by using the input spectrum of the selected selection band. As a result, it is possible to improve the accuracy of the pitch frequency estimation.

In addition, since the speech processing apparatus 200 calculates the change amount $\Delta_T$ of the input spectrum in the time direction and the change amount $\Delta_F$ in the frequency direction for each sub-band and selects a selection band which is likely to be a speech, it is possible to accurately select a band which is likely to be a speech.

Example 3

Figure 11:
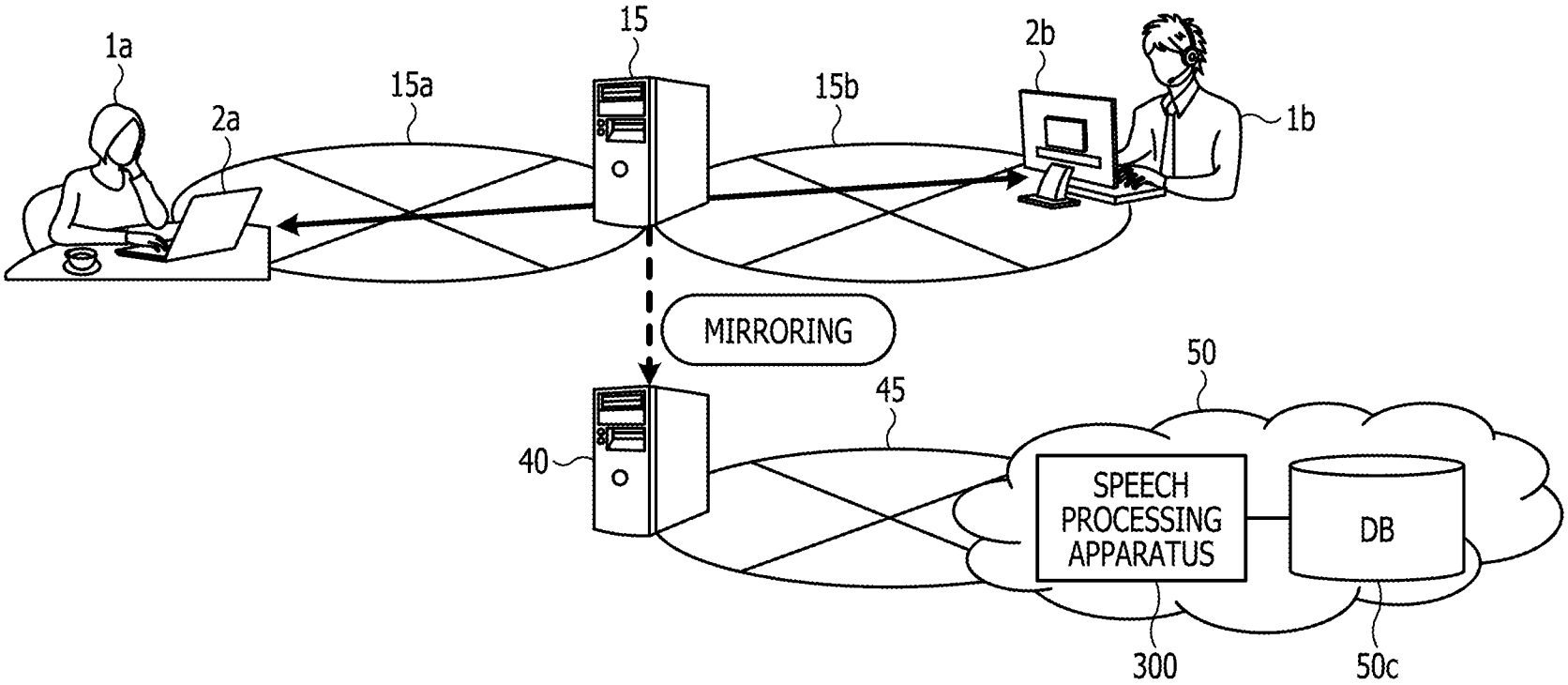
FIG. 11 is a diagram illustrating an example of a speech processing system according to Example 3.

FIG. 11 is a diagram illustrating an example of a speech processing system according to Example 3. As illustrated in FIG. 11, this speech processing system includes the terminal devices 2*a* and 2*b*, the GW 15, a recording server 40, and a cloud network 50. The terminal device 2*a* is connected to the GW 15 via the telephone network 15*a*. The terminal device 2*b* is connected to the GW 15 via the individual network 15*b*. The GW 15 is connected to the recording server 40. The recording server 40 is connected to the cloud network 50 via a maintenance network 45.

The cloud network 50 includes a speech processing apparatus 300 and a DB 50*c*. The speech processing apparatus 300 is connected to the DB 50*c*. The processing of the speech processing apparatus 300 may be executed by a plurality of servers (not illustrated) on the cloud network 50.

The terminal device 2*a* transmits a signal of the speech (or other than speech) of the speaker 1*a* collected by a microphone (not illustrated) to the GW 15. In the following description, a signal transmitted from the terminal device 2*a* is referred to as a first signal.

The terminal device 2*b* transmits a signal of the speech (or other than speech) of the speaker 1*b* collected by a microphone (not illustrated) to the GW 15. In the following description, a signal transmitted from the terminal device 2*b* is referred to as a second signal.

The GW 15 stores the first signal received from the terminal device 2*a* in the first buffer of the storage unit (not illustrated) of the GW 15 and transmits the first signal to the terminal device 2*b*. The GW 15 stores the second signal received from the terminal device 2*b* in the second buffer of the storage unit of the GW 15 and transmits the second signal to the terminal device 2*a*. In addition, the GW 15 performs mirroring with the recording server 40 and registers the information of the storage unit of the GW 15 in the storage unit of the recording server 40.

By performing mirroring with the GW 15, the recording server 40 registers the information of the first signal and the information of the second signal in the storage unit (the storage unit 42 to be described later) of the recording server 40. The recording server 40 calculates the input spectrum of the first signal by converting the first signal from a time domain to a frequency domain and transmits information of the calculated input spectrum of the first signal to the speech processing apparatus 300. The recording server 40 calculates the input spectrum of the second signal by converting the second signal from a time domain to a frequency domain and transmits information of the calculated input spectrum of the second signal to the speech processing apparatus 300.

The DB 50*c* stores an estimation result of the pitch frequency by the speech processing apparatus 300. For example, the DB 50*c* corresponds to a semiconductor memory element such as a RAM, a ROM, a flash memory, or a storage device such as an HDD.

The speech processing apparatus 300 estimates the pitch frequency of the speaker 1*a* based on the input spectrum of the first signal received from the recording server 40 and stores the estimation result in the DB 50*c*. The speech processing apparatus 300 estimates the pitch frequency of the speaker 1*b* based on the input spectrum of the second signal received from the recording server 40 and stores the estimation result in the DB 50*c*.

Figure 12:
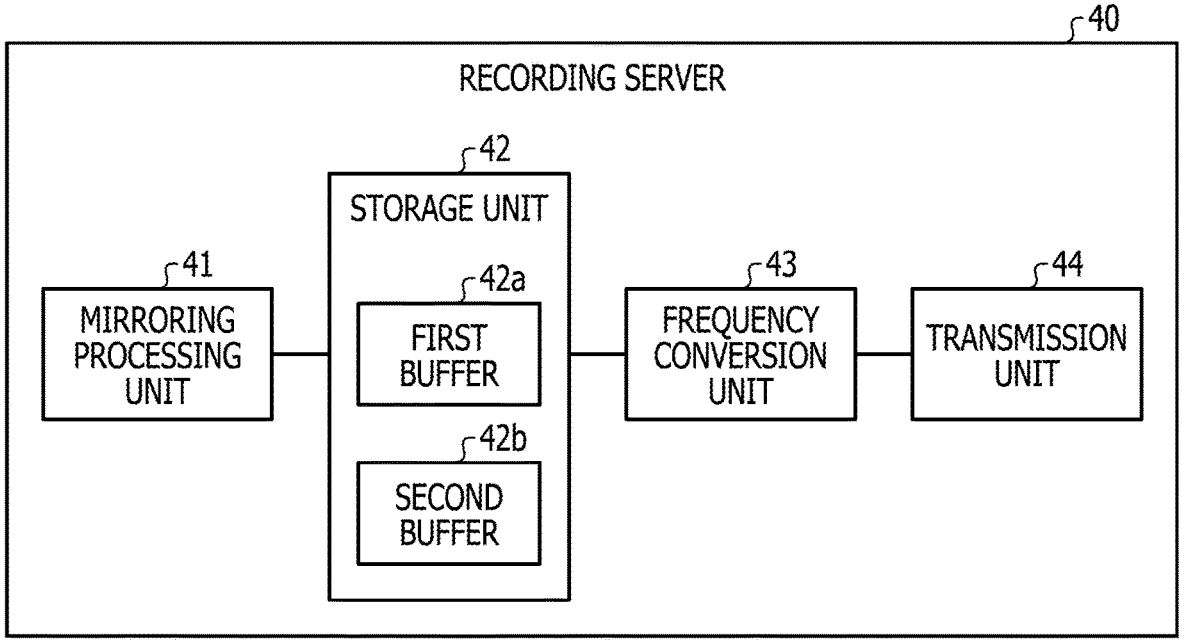
FIG. 12 is a functional block diagram illustrating a configuration of a recording server according to Example 3.

FIG. 12 is a functional block diagram illustrating a configuration of a recording server according to Example 3. As illustrated in FIG. 12, the recording server 40 includes a mirroring processing unit 41, a storage unit 42, a frequency conversion unit 43, and a transmission unit 44.

The mirroring processing unit 41 is a processing unit that performs mirroring by executing data communication with the GW 15. For example, the mirroring processing unit 41 acquires the information of the storage unit of the GW 15 from the GW 15 and registers and updates the acquired information in the storage unit 42.

The storage unit 42 includes a first buffer 42*a* and a second buffer 42*b*. The storage unit 42 corresponds to a semiconductor memory element such as a RAM, a ROM, a flash memory, or a storage device such as an HDD.

The first buffer 42*a* is a buffer that holds the information of the first signal. The second buffer 42*b* is a buffer that holds the information of the second signal. It is assumed that the first signal stored in the first buffer 42*a* and the second signal stored in the second buffer 42*b* are AD-converted signals.

The frequency conversion unit 43 acquires the first signal from the first buffer 42*a* and calculates the input spectrum of the frame based on the first signal. In addition, the frequency conversion unit 43 acquires the second signal from the second buffer 42*b* and calculates the input spectrum of the frame based on the second signal. In the following description, the first signal or the second signal will be denoted as "input signal" unless otherwise distinguished. The processing of calculating the input spectrum of the frame of the input signal by the frequency conversion unit 43 corresponds to the processing of the frequency conversion unit 120, and thus the description thereof will be omitted. The frequency conversion unit 43 outputs the information on the input spectrum of the input signal to the transmission unit 44.

The transmission unit 44 transmits the information on the input spectrum of the input signal to the speech processing apparatus 300 via the maintenance network 45.

Figure 13:
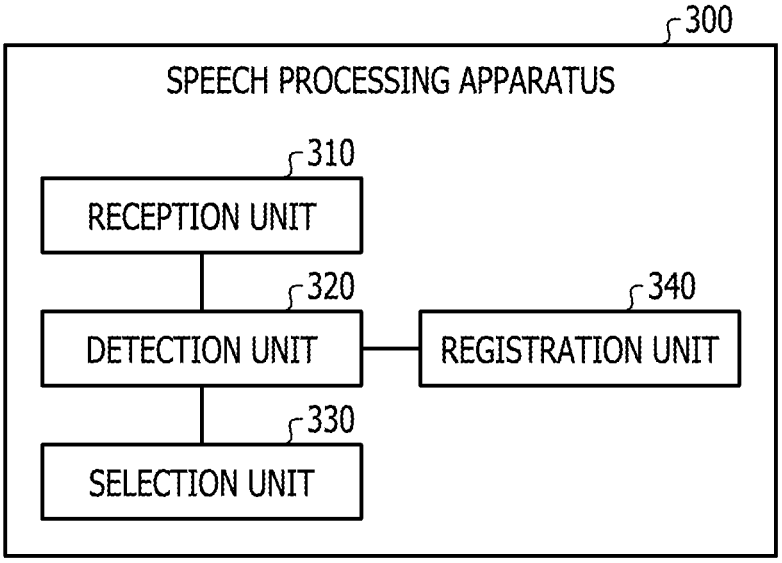
FIG. 13 is a functional block diagram illustrating a configuration of a speech processing apparatus according to Example 3.

Subsequently, the configuration of the speech processing apparatus 300 described will be described with reference to FIG. 11. FIG. 13 is a functional block diagram illustrating the configuration of the speech processing apparatus according to Example 3. As illustrated in FIG. 13, the speech processing apparatus 300 includes a reception unit 310, a detection unit 320, a selection unit 330, and a registration unit 340.

The reception unit 310 is a processing unit that receives information on an input spectrum of an input signal from the transmission unit 44 of the recording server 40. The reception unit 310 outputs the information of the input spectrum to the detection unit 320.

The detection unit 320 is a processing unit that works together with the selection unit 330 to detect a pitch frequency. The detection unit 320 outputs the information on the detected pitch frequency to the registration unit 340. An example of the processing of the detection unit 320 will be described below.

Like the detection unit 150, the detection unit 320 normalizes the input spectrum based on Equations (6) and (7). The normalized input spectrum is referred to as a normalized spectrum.

The detection unit 320 calculates a correlation between the normalized spectrum and the COS waveform for each sub-band based on Equation (16). In Equation (16), $R_{SUB}(g, l)$ is a correlation between the COS waveform of the cycle "g" and the normalized spectrum of the sub-band with the sub-band number "l".

$$R_{SUB}(g, 1) = \sum_{j=1}^{N_{SUB}} (P_n((1-1)\cdot L + j)\cdot \cos(2\pi j/g)) \tag{16}$$

Based on Equation (17), the detection unit 320 performs processing of adding a correlation R(g) of the entire band only in a case where the correlation of the sub-band is equal to or larger than a threshold value TH3.

$$R(g) = \sum_{k=1}^{L} (R_{SUB}(g, k) \mid \text{if } (R_{SUB}(g, k) > TH_3)) \tag{17}$$

For the convenience of description, the detection unit 320 will be described with the cycle of the COS waveform as "g1, g2, and g3". For example, by calculation based on Equation (16), among the $R_{SUB}(g1, l)$ (l=1, 2, 3, 4, and 5), those having the threshold value TH3 or more are $R_{SUB}(g1, 1)$, $R_{SUB}(g1, 2)$, and $R_{SUB}(g1, 3)$. In this case, a correlation $R(g1)=R_{SUB}(g1, 1)+R_{SUB}(g1, 2)+R_{SUB}(g1, 3)$.

By calculation based on Equation (16), among the $R_{SUB}(g2, l)$ (l=1, 2, 3, 4, and 5), those having the threshold value TH3 or more are $R_{SUB}(g2, 2)$, $R_{SUB}(g2, 3)$, and $R_{SUB}(g2, 4)$. In this case, a correlation $R(g2)=R_{SUB}(g2, 2)+R_{SUB}(g2, 3)+R_{SUB}(g2, 4)$.

By calculation based on Equation (16), among the $R_{SUB}(g3, l)$ (l=1, 2, 3, 4, and 5), those having the threshold value TH3 or more are $R_{SUB}(g3, 3)$, $R_{SUB}(g3, 4)$, and $R_{SUB}(g3, 5)$. In this case, a correlation $R(g3)=R_{SUB}(g3, 3)+R_{SUB}(g3, 4)+R_{SUB}(g3, 5)$.

The detection unit 320 outputs information on each correlation R(g) to the selection unit 330. The selection unit 330 selects a selection band based on each correlation R(g). In the selection unit 330, the sub-band corresponding to the maximum correlation R(g) among the correlations R(g) is a selection band. For example, in a case where the correlation R(g2) is the maximum among the correlation R(g1), the correlation R(g2), and the correlation R(g3), the sub-bands with sub-band numbers "2, 3, 4" is selection bands.

The detection unit 320 calculates the pitch frequency F0 based on Equation (18). In the example illustrated in Equation (18), the cycle "g" of the correlation R(g) which is the maximum among the correlations R(g) is calculated as the pitch frequency F0.

$$F0=\text{argmax}(R(g)) \tag{18}$$

The detection unit 320 may receive the information on the selection band from the selection unit 330, detect the correlation R(g) calculated from the selection band from each correlation R(g), and detect the cycle "g" of the detected correlation R(g) as the pitch frequency F0.

The registration unit 340 is a processing unit that registers the information on the pitch frequency of each frame detected by the detection unit 320 in the DB 50*c*.

Figure 14:
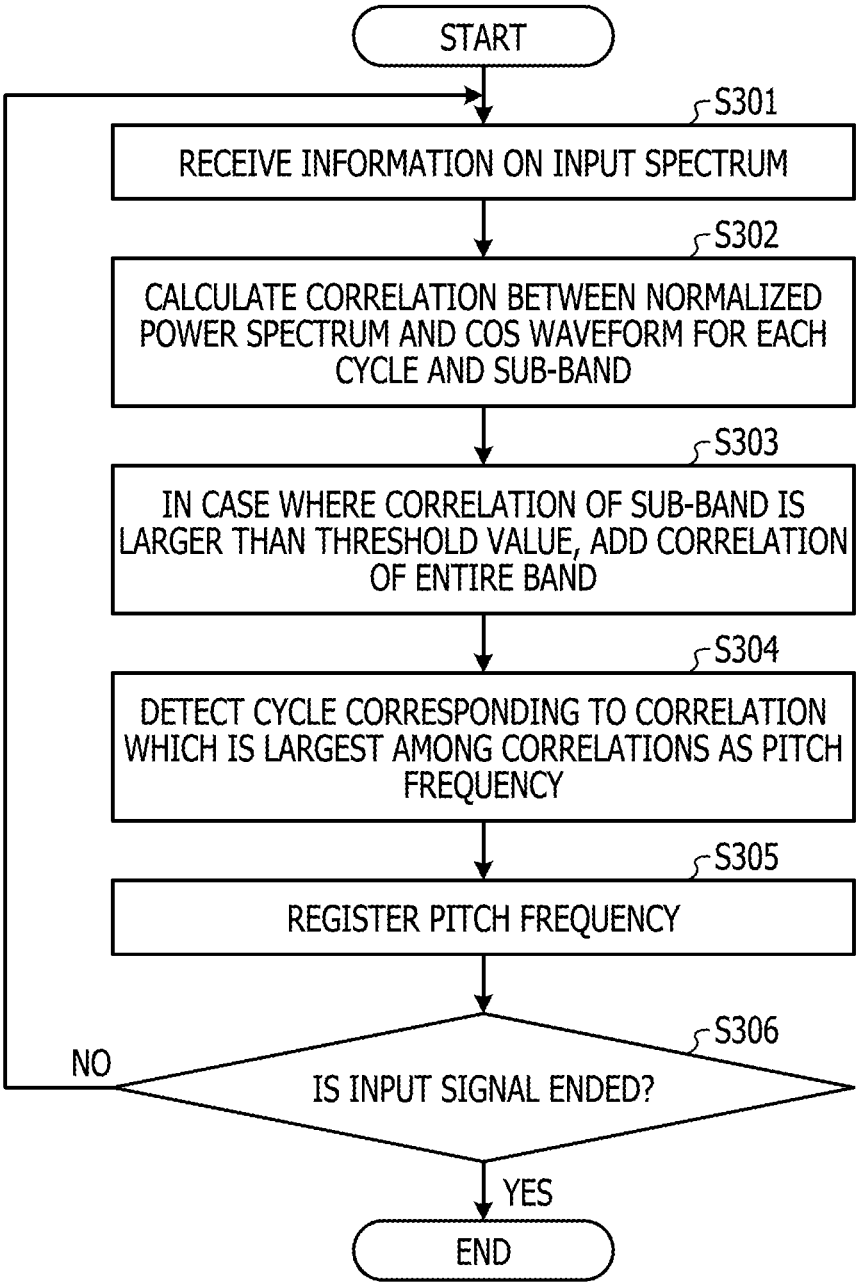
FIG. 14 is a flowchart illustrating a processing procedure of the speech processing apparatus according to Example 3.

Next, a processing procedure of the speech processing apparatus 300 according to Example 3 will be described. FIG. 14 is a flowchart illustrating a processing procedure of the speech processing apparatus according to Example 3. As illustrated in FIG. 14, the reception unit 310 of the speech processing apparatus 300 receives the input spectrum information from the recording server 40 (step S301).

The detection unit 320 of the speech processing apparatus 300 calculates the correlation $R_{SUB}$ between the normalized power spectrum and the COS waveform for each cycle and sub-band (step S302). In the case where the correlation $R_{SUB}$ of the sub-band is larger than the threshold value TH3, the detection unit 320 adds the correlation R(g) of the entire band (step S303).

The detection unit 320 detects a cycle corresponding to the correlation R(g) which is the largest among the correlations R(g) as a pitch frequency (step S304). The registration unit 340 of the speech processing apparatus 300 registers the pitch frequency (step S305).

When the input spectrum is not terminated (step S306, No), the detection unit 320 proceeds to step S301. On the other hand, in a case where the input spectrum is ended (step S306, Yes), the detection unit 320 ends the processing.

Next, the effect of the speech processing apparatus 300 according to Example 3 will be described. The speech processing apparatus 300 calculates a plurality of cosine waveforms having different cycles, input spectra for the respective bands, and respective correlations and detects a cycle of the cosine waveform used for calculating the correlation which is the largest among the correlations as a pitch frequency. As a result, it is possible to improve the accuracy of the pitch frequency estimation.

Figure 15:
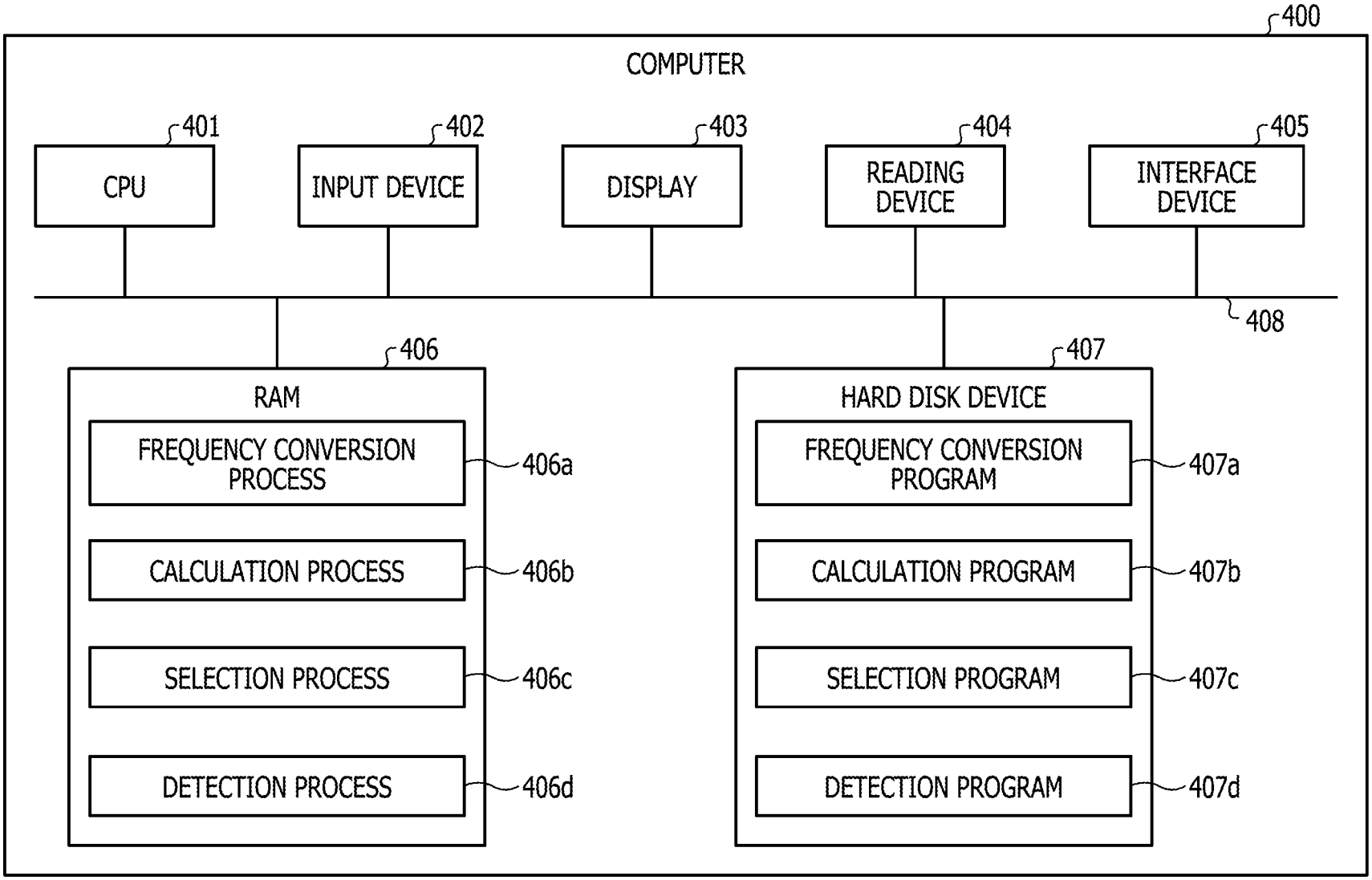
FIG. 15 is a diagram illustrating an example of a hardware configuration of a computer that realizes a function similar to that of the speech processing apparatus.
Figure 16:
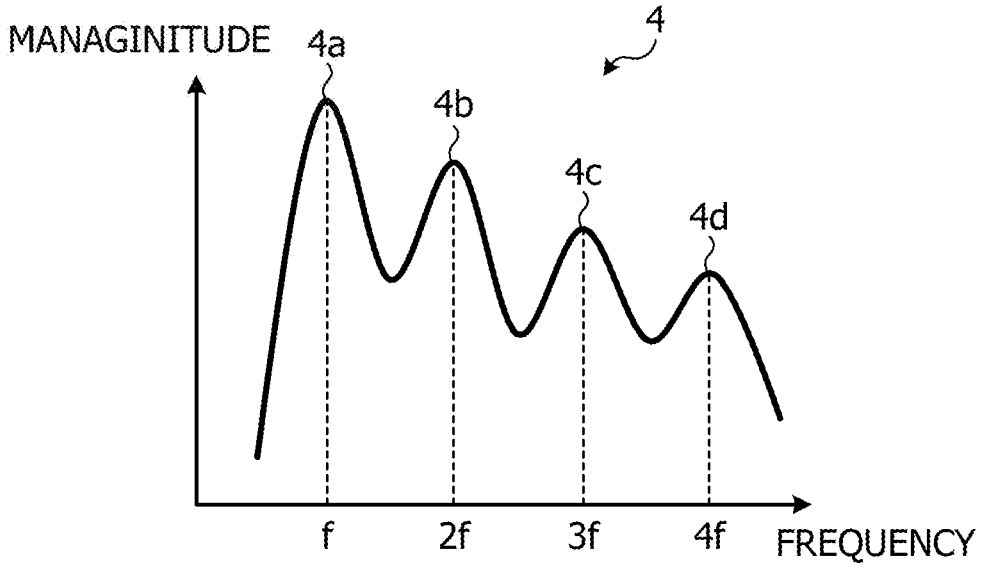
FIG. 16 (RELATED ART)
FIG. 16 is a diagram for describing terms related to an input spectrum.
Figure 17:
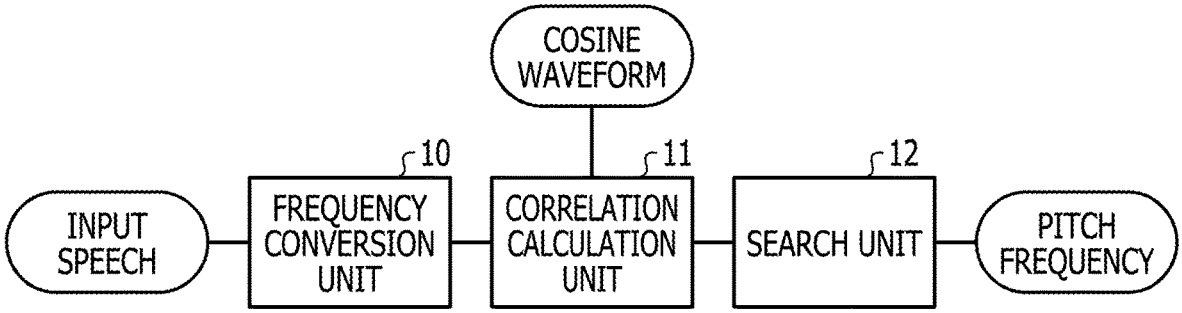
FIG. 17 (RELATED ART)
FIG. 17 is a diagram (1) for describing the related art.
Figure 18:
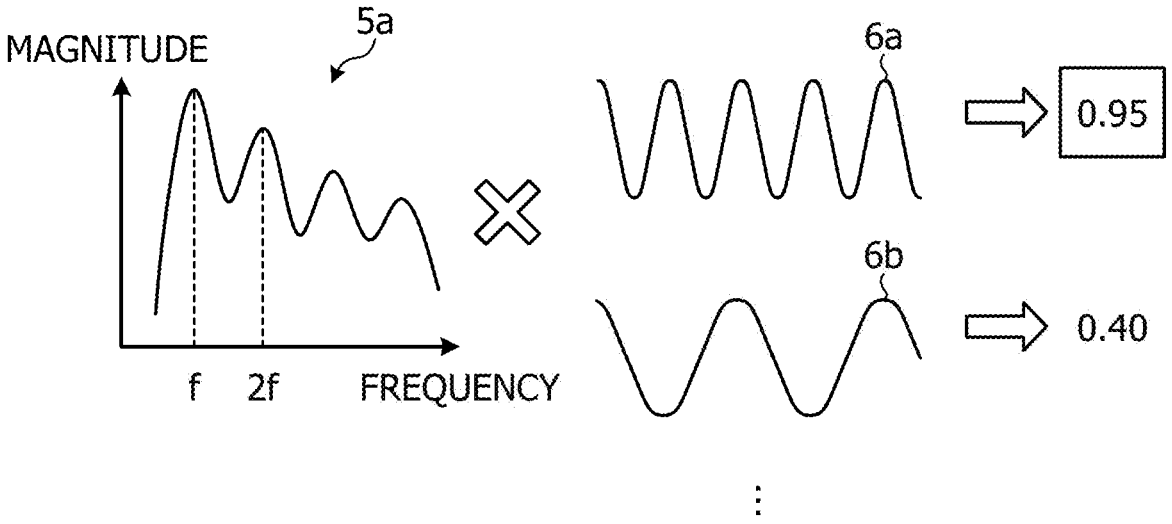
FIG. 18 (RELATED ART)
FIG. 18 is a diagram (2) for describing the related art.

Next, an example of a hardware configuration of a computer that realizes the same functions as those of the speech processing apparatuses 100, 200, and 300 illustrated in the above examples will be described. FIG. 15 is a diagram illustrating an example of a hardware configuration of the computer that realizes a function similar to that of the speech processing apparatus.

As illustrated in FIG. 15, a computer 400 includes a CPU 401 that executes various arithmetic processing, an input device 402 that receives inputs of data from the user, and a display 403. In addition, the computer 400 includes a reading device 404 that reads a program or the like from a storage medium and an interface device 405 that exchanges data with a recording device or the like via a wired or wireless network. In addition, the computer 400 includes a RAM 406 for temporarily storing various kinds of information and a hard disk device 407. Then, each of the devices 401 to 407 is connected to a bus 408.

The hard disk device 407 has a frequency conversion program 407*a*, a calculation program 407*b*, a selection program 407*c*, and a detection program 407*d*. The CPU 401 reads out the programs 407*a* to 407*d* and develops the programs in the RAM 406.

The frequency conversion program 407*a* functions as a frequency conversion process 406*a*. The calculation program 407*b* functions as a calculation process 406*b*. The selection program 407*c* functions as a selection process 406*c*. The detection program 407*d* functions as a detection process 406*d*.

The processing of the frequency conversion process 406*a* corresponds to the processing of the frequency conversion units 120 and 220. The processing of the calculation process 406*b* corresponds to the processing of the calculation units 130 and 230. The processing of the selection process 406*c* corresponds to the processing of the selection units 140, 240, and 330. The processing of the detection process 406*d* corresponds to the processing of the detection units 150, 250, and 320.

The programs 407*a* to 407*d* do not necessarily have to be stored in the hard disk device 407 from the beginning. For example, the program is stored in a "portable physical medium" such as a flexible disk (FD), a CD-ROM, a DVD disk, a magneto-optical disk, an IC card inserted into the computer 400. Then, a computer 400 may read and execute the programs 407*a* to 407*d*.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. A speech processing method for estimating a pitch frequency, the method comprising:

executing a first feature amount acquisition process that includes acquiring a first feature amount of speech likeness based on a first input signal;

executing a first selection process that includes selecting a first selection band based on the first feature amount of speech likeness, from a target band;

executing a conversion process that includes acquiring an input spectrum from a second input signal by converting the second input signal from a time domain to a frequency domain, the second input signal being received after receiving the first signal;

executing a second feature amount acquisition process that includes acquiring a second feature amount of speech likeness for each band included in the first selection band based on the input spectrum;

executing a second selection process that includes selecting a second selection band selected from the first selection band based on the second feature amount of speech likeness for each band; and executing a detection process that includes detecting a pitch frequency based on the input spectrum and the second selection band.

2. The speech processing method according to claim 1, wherein the conversion process is configured to calculate the input spectrum from each frame included in the second input signal, and the second feature amount acquisition process is configured to calculate the second feature amount based on a power or signal noise ratio (SNR) of the input spectrum of each frame.

3. The speech processing method according to claim 1, wherein the selection process is configured to select the second selection band based on an average value of the second feature amount corresponding to the target band and the second feature amount of each band.

4. The speech processing method according to claim 1, wherein the second feature amount acquisition process is configured to calculate a change amount of the input spectrum in a frequency direction as the second feature amount.

5. The speech processing method according to claim 4, wherein the conversion process is configured to calculate the input spectrum from each frame included in the second input signal, and the second feature amount acquisition process is configured to calculate a change amount between an input spectrum of a first frame and an input spectrum of a second frame after the first frame as the feature amount.

6. The speech processing method according to claim 5, wherein the second selection process is configured to select the second selection band based on the change amount of the input spectrum in the frequency direction and the change amount between the input spectrum of the first frame and the input spectrum of the second frame.

7. The speech processing method according to claim 1, wherein the detection process is configured to calculate respective correlations between a plurality of cosine waveforms having different cycles and input spectra for the respective bands, and detect a cycle of a cosine waveform used for calculating a largest correlation among the correlations as the pitch frequency.

8. A speech processing apparatus for estimating a pitch frequency, the apparatus comprising:

a memory; and a processor coupled to the memory and configured to:

execute a first feature amount acquisition process that includes acquiring a first feature amount of speech likeness based on a first input signal, execute a first selection process that includes selecting a first selection band based on the first feature amount of speech likeness, from a target band, execute a conversion process that includes acquiring an input spectrum from a second input signal by converting the second input signal from a time domain to a frequency domain, the second input signal being received after receiving the first signal, execute a second feature amount acquisition process that includes acquiring a second feature amount of speech likeness for each band included in the first selection band based on the input spectrum, execute a second selection process that includes selecting a second selection band selected from the first selection band based on the second feature amount of speech likeness for each band, and execute a detection process that includes detecting a pitch frequency based on the input spectrum and the second selection band.

9. The speech processing apparatus according to claim 8, wherein the conversion process is configured to calculate the input spectrum from each frame included in the second input signal, and the second feature amount acquisition process is configured to calculate the feature amount based on a power or signal noise ratio (SNR) of the input spectrum of each frame.

10. The speech processing apparatus according to claim 9, wherein the selection process is configured to select the second selection band based on an average value of the second feature amount corresponding to the target band and the second feature amount of each band.

11. The speech processing apparatus according to claim 8, wherein the second feature amount acquisition process is configured to calculate a change amount of the input spectrum in a frequency direction as the second feature amount.

12. The speech processing apparatus according to claim 11, wherein the conversion process is configured to calculate the input spectrum from each frame included in the second input signal, and the second feature amount acquisition process is configured to calculate a change amount between an input spectrum of a first frame and an input spectrum of a second frame after the first frame as the feature amount.

13. The speech processing apparatus according to claim 12, wherein the second selection process is configured to select the second selection band based on the change amount of the input spectrum in the frequency direction and the change amount between the input spectrum of the first frame and the input spectrum of the second frame.

14. The speech processing method according to claim 8, wherein the detection process is configured to calculate respective correlations between a plurality of cosine waveforms having different cycles and input spectra for the respective bands, and detect a cycle of a cosine waveform used for calculating a largest correlation among the correlations as the pitch frequency.

15. A non-transitory computer-readable storage medium for storing a speech processing computer program, the speech processing computer program which causes a processor to perform processing for estimating a pitch frequency, the processing comprising:

executing a first feature amount acquisition process that includes acquiring a first feature amount of speech likeness based on a first input signal;

executing a first selection process that includes selecting a first selection band based on the first feature amount of speech likeness, from a target band;

executing a conversion process that includes acquiring an input spectrum from second input signal by converting the second input signal from a time domain to a frequency domain, the second input signal being received after receiving the first signal;

executing a feature amount acquisition process that includes acquiring a feature amount of speech likeness for each band included in the first selection band based on the input spectrum;

executing a second selection process that includes selecting a second selection band selected from the first selection band based on the second feature amount of speech likeness for each band; and executing a detection process that includes detecting a pitch frequency based on the input spectrum and the second selection band.

16. The non-transitory computer-readable storage medium according to claim 15, wherein the conversion process is configured to calculate the input spectrum from each frame included in the second input signal, and the second feature amount acquisition process is configured to calculate the feature amount based on a power or signal noise ratio (SNR) of the input spectrum of each frame.

17. The non-transitory computer-readable storage medium according to claim 15, wherein the selection process is configured to select the second selection band based on an average value of the second feature amount corresponding to the target band and the second feature amount of each band.

18. The non-transitory computer-readable storage medium according to claim 15, wherein the second feature amount acquisition process is configured to calculate a change amount of the input spectrum in a frequency direction as the second feature amount.

19. The non-transitory computer-readable storage medium according to claim 18, wherein the conversion process is configured to calculate the input spectrum from each frame included in the second input signal, and the second feature amount acquisition process is configured to calculate a change amount between an input spectrum of a first frame and an input spectrum of a second frame after the first frame as the feature amount.

20. The non-transitory computer-readable storage medium according to claim 19, wherein the second selection process is configured to select the second selection band based on the change amount of the input spectrum in the frequency direction and the change amount between the input spectrum of the first frame and the input spectrum of the second frame.

* * * * *